United States Patent [19]

Johnson

[11] 4,090,755

[45] May 23, 1978

[54] CABINET ASSEMBLY

[75] Inventor: Frank S. Johnson, Chicago, Ill.

[73] Assignee: Marvel Metal Products Company, Chicago, Ill.

[21] Appl. No.: 756,374

[22] Filed: Jan. 3, 1977

[51] Int. Cl.[2] ..... A47B 43/00; A47B 48/00; A47F 3/00; F16B 12/00

[52] U.S. Cl. ..... 312/257 R; 312/140

[58] Field of Search ..... 312/257 R, 257 A, 257 SK, 312/257 SM, 195

[56] References Cited

U.S. PATENT DOCUMENTS

| | | | |
|---|---|---|---|
| 1,345,366 | 7/1920 | Jippson | 312/257 R |
| 1,729,475 | 9/1929 | Brainard et al. | 312/257 R |
| 2,505,299 | 4/1950 | Muller | 312/257 R |
| 2,514,631 | 7/1950 | Elvers | 312/257 SK |
| 2,652,308 | 9/1953 | Peterson | 312/250 |
| 2,992,055 | 7/1961 | Kass | 312/257 SK |
| 3,037,814 | 6/1962 | Gardner et al. | 297/460 |
| 3,105,726 | 10/1963 | Jung | 312/257 A |
| 3,360,321 | 12/1967 | Novales | 312/257 R |
| 3,748,009 | 7/1973 | Stone | 312/257 R |
| 3,966,285 | 6/1976 | Porch et al. | 312/257 SK |

FOREIGN PATENT DOCUMENTS

| | | | |
|---|---|---|---|
| 1,590,062 | 4/1970 | Germany | 312/257 A |
| 960,362 | 6/1964 | United Kingdom | 312/257 SM |

*Primary Examiner*—Paul R. Gilliam
*Assistant Examiner*—Victor N. Sakran
*Attorney, Agent, or Firm*—Wallenstein, Spangenberg, Hattis & Strampel

[57] ABSTRACT

A cabinet assembly of the knockdown type which can be packaged and shipped in an easily handled, relatively compact container, and which can be readily assembled by a user into an attractive, durable, multi-purpose cabinet. The assembly comprises top and bottom members, side members, a rear member, two cross-members, and doors. One, or more, shelves may be provided for the cabinet. Threaded, screw-engaging, nut-like elements are welded directly onto various of the members comprising the assembly to facilitate interconnection of the members into a rigid, high-strength structure. Casters may be provided for the cabinet to enable it to be moved to any desired location.

2 Claims, 8 Drawing Figures

CABINET ASSEMBLY

This invention relates to a cabinet assembly and, in particular, is directed to an improved cabinet assembly of the knockdown type.

In order to reduce freight costs, and to enable the easy handling and shipment of cabinets, particularly cabinets of the knockdown type, it has been the practice to package and ship such items in unassembled form, leaving the assembly of the cabinet to the ultimate user. Such cabinets, known in the trade as knockdown cabinets, have filled a need in the cabinet industry, and have met with widespread acceptance by the purchasing public.

In accordance with the present invention, an improved cabinet assembly of the knockdown type is provided which not only enables it to be packaged and shipped in an easily handled, relatively compact container but, also, enables the ultimate user to readily and easily assemble the components of the cabinet by means of a simple tool. The assembled structure, while being rigid and of high strength, is attractive in appearance. The fastening means used in assembling the components of the cabinet are concealed in the finished structure. In a preferred embodiment of the assembly, casters are provided to enable the finished cabinet to be moved to any desired location. In addition, one or more shelves may advantageously be provided as part of the cabinet assembly.

The cabinet assembly of this invention, in brief, comprises a top member, a base or bottom member, side members, a rear or back member, two cross pieces or rails, and doors. The side members are adapted to be secured at their lower margin on the base member, and at their upper margin to the cross pieces or rails. The side members are provided with openings for enabling the top member to be guided and secured in position on the upper margins of the side members. The rear or back member is provided with base member and cross piece engaging means which enable it to be simply snapped into a locked position. The doors of the cabinet have cooperating hinge elements which are secured by means of pins on the front margins of the side members. Threaded, screw-engaging, nut-like elements are preselectively secured as by welding to various components of the cabinet assembly to enable, as stated, easy interconnection of the components into a rigid, high-strength structure by means of only a simple tool. The top member of the assembly is packaged with fastening means partially mounted thereon to enable the top member to be engaged on the upper margins of the side members and securely locked in position with minimum effort on the part of the assembler. Openings are provided in the bottom wall of the base or bottom member for receiving casters whereby the assembled cabinet can be freely moved by a user to any location desired. The assembly, as indicated, further may include one or more shelves which can readily and easily be positioned within the cabinet by the assembler.

These and other features of the cabinet assembly will become apparent from the following description taken in conjunction with the drawings in which.

Figure 1:
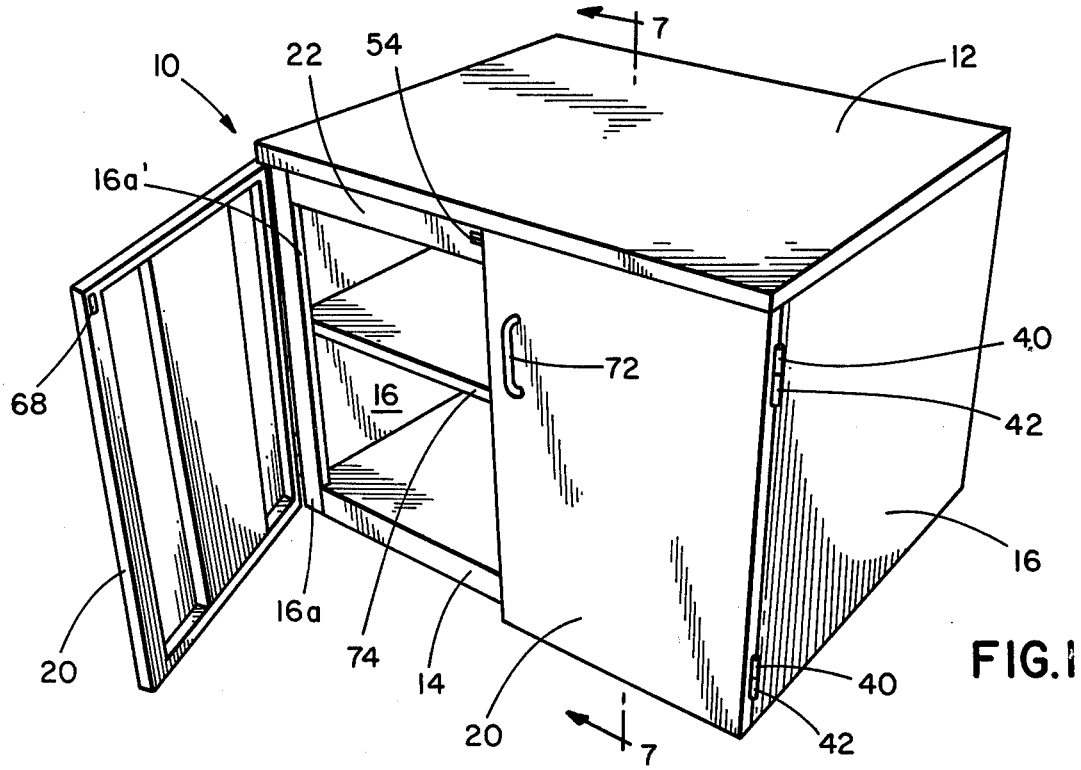
FIG. 1 is a view in perspective of an embodiment of the cabinet assembly of this invention.

Referring, now, in greater detail to the drawings, the main components of the cabinet assembly 10, as shown, comprise a top member 12, a base or bottom member 14, side members 16—16, a rear or back member 18, doors 20—20, a front cross piece or rail 22, and a rear cross piece or rail 24.

The components of the cabinet assembly advantageously are fabricated of metal. The ancillary hardware including screws, hinge pins, door handles and casters are provided with the assembly.

The base member 14 comprises a top wall **14*a* having a pair of spaced openings 26—26 along the rear margin thereof, the function of which will become clear as the description proceeds. The member 14 also has front, side and rear walls. The front wall 14*b* and the rear wall 14*c* of the member 14 are provided with a pair of vertically arranged, screw-receiving openings 28—28 at each end thereof. Threaded, screw-engaging, nut-like elements (not shown) are secured as by welding on the inner surface of the front wall 14*b* and the rear wall 14*c* at the openings 28—28** formed therein.

Figure 8:
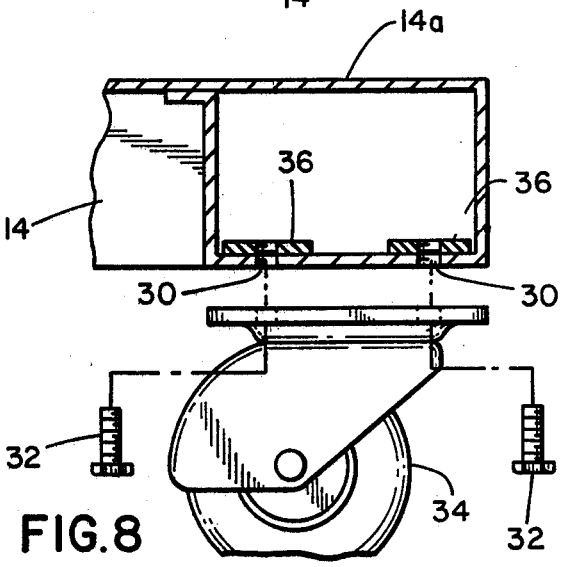
FIG. 8 is a sectional view taken at one corner of the base or bottom member, and showing the manner in which casters are secured thereto.

As best shown in FIG. 8, the sides of the bottom member 14 are of box-like construction, and the lowermost wall thereof is provided with screw-receiving openings 30—30 at the front and rear end thereof for receiving screws 32—32 by means of which a caster 34 is secured to the underside of the bottom member 14 at each corner thereof. Threaded, screw-engaging, nut-like elements 36—36 are secured as by welding on the inner surface of the base member 14 at the openings 30—30 therein.

The side members 16—16 of the assembly 10 have an inwardly extending front flange **16*a* provided with vertically arranged, screw-receiving openings 38—38 at the upper and the lower end thereof. The inner edge of the front flange 16*a*, centrally of the upper and lower ends thereof, is integrally connected to a U-shaped base member and front rail engaging portion 16*a*′. The innermost side of the portion 16*a*′ has a plurality of vertically spaced shelf-bracket receiving slots (not shown) formed therein. Along the outer edge of the front flange 16*a*, a pair of spaced hinge plates 40—40 are provided which cooperate with hinge plates 42—42 on the doors 20—20 for hanging the doors on the side members 16—16. The side members 16—16 are further provided with an inwardly extending rear flange 16*b* having spaced, vertically arranged, screw-receiving openings 44—44 at the upper end thereof. The rear flange 16*b*, in addition to the openings 44—44, has a plurality of vertically spaced, shelf-bracket receiving slots 46 formed therein which are located in opposed relation to the slots in the innermost side of the portion 16***a'*. Below the bottom edge of the rear flange 16*b* there is provided a base member engaging extension or leg 16*c* having screw-receiving openings 48—48 therein. The side members 16—16 also are provided with an inwardly extending upper flange 16*d* having keyhole slots 50—50 formed at each end thereof.

The upper end of each side member 16—16 is adapted to be secured to the ends of the front cross piece or rail 22. The front rail 22 has a generally U-shaped cross section, and is provided with a pair of spaced, vertically arranged, screw-receiving openings 52—52 at the ends thereof. Secured as by welding on the inner wall of the rail 22 at the openings 52—52 therethrough, are threaded, screw-engaging, nut-like elements (not shown) similar to the elements 36—36 on the base member 14. A door securing magnet 54 is provided on the front face of the web of the rail 22.

The upper end of each of the rear flanges 16*b*—16*b* of the side members 16—16 are adapted to be secured to the ends of the rear cross piece or rail 24. The rail 24, like the rail 22, is generally U-shaped in cross section and is provided with screw-receiving openings 56—56 at the ends thereof. Threaded, screw-engaging, nut-like elements 58—58 similar to the elements 36—36, are secured as by welding on the inner surface of the web of the rail 24 at the openings 56—56 therethrough. Adjacent to, and inwardly of, the ends of the rail 24, there is provided a pair of fastening clips 60—60, the function of which will become clear as the description proceeds.

The rear or back member 18 of the cabinet assembly 10 has inwardly extending side flanges 18*a*—18*a*, and an upper L-shaped, inwardly extending flange 18*b*. The flange 18*b* has a pair of spaced ball studs 62—62 which are adapted to be received in the fastening clips 60—60 in the rail 24. Above the lower margin of the member 18, and inwardly of the flanges 18*a*—18*a* thereof, an L-shaped base member-engaging support bar 18*c* is secured to the inner face of the member 18. The support bar 18*c* has a pair of downwardly extending studs or pins 66—66 which are adapted to be received in the openings 26—26 in the top wall 14*a* of the base member 14.

The doors 20—20 of the assembly have boxed edges, and are provided with striking plates 68—68 at the upper corners thereof which cooperate with the magnet 54 on the rail 22 for maintaining the doors in a closed position. The outer margin of each of the doors 20—20 is, as stated, provided with spaced hinge plates 42—42 which cooperate with the hinge plates 40—40 on the side members 16—16 for hanging the doors on the side members. Pins 70—70 are employed for maintaining the hinge plates 40—40 and 42—42 in operative relation to one another. Handles 72—72 are provided for each of the doors.

Figure 3:
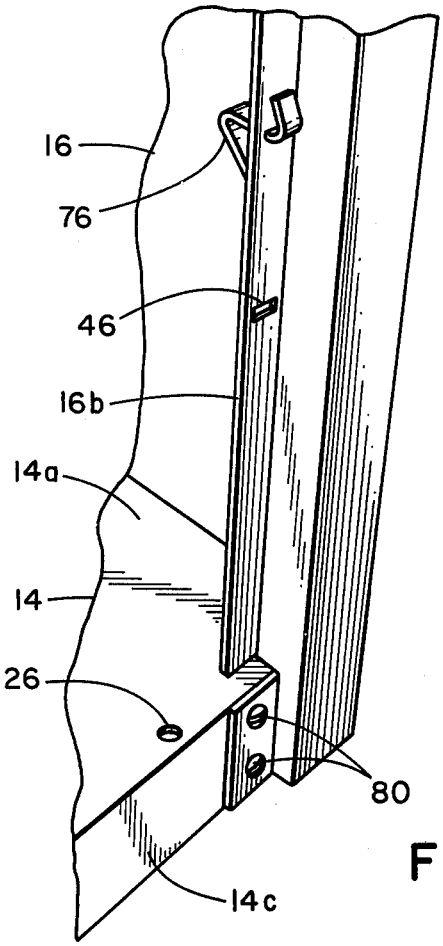
FIG. 3 is an enlarged fragmentary perspective view showing the manner in which the side members are attached to the base member of the assembly, and showing means for supporting one or more shelves in the cabinet.
Figure 4:
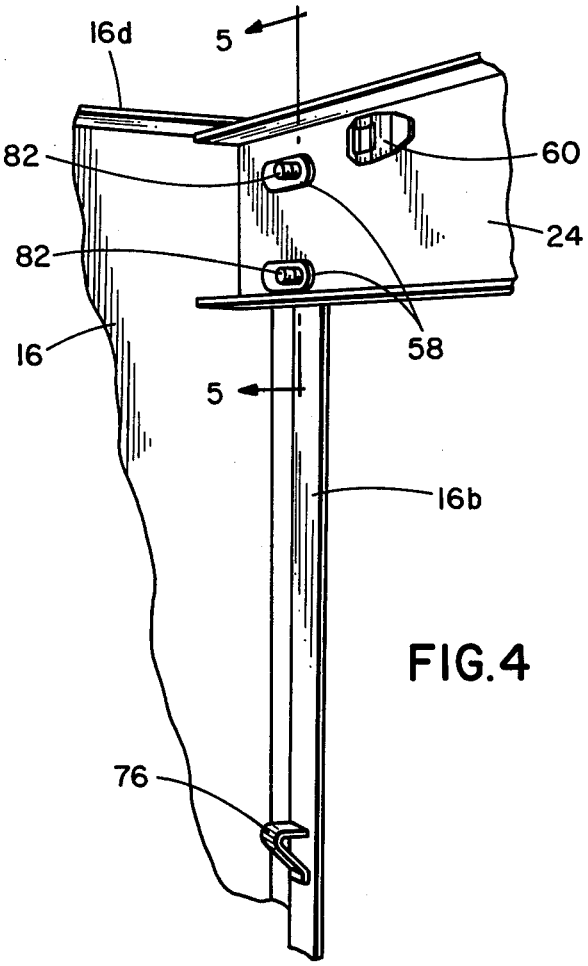
FIG. 4 is an enlarged fragmentary view in perspective showing a side member attached to a cross piece of the assembly and, in addition, showing the threaded, screw-engaging, nut-like elements on the cross piece.
Figure 2:
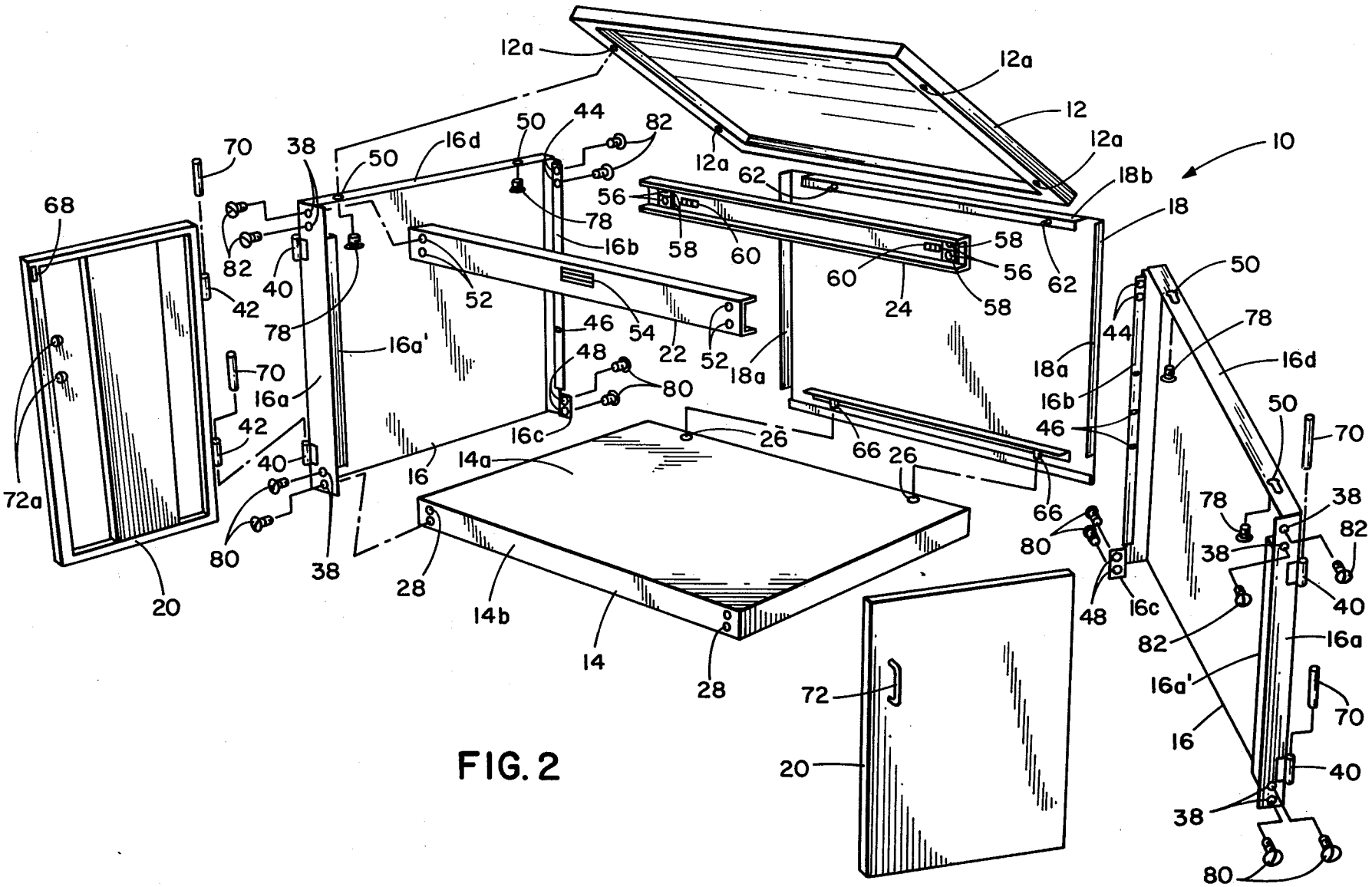
FIG. 2 is an exploded view of the components comprising the cabinet assembly of this invention.
Figure 5:
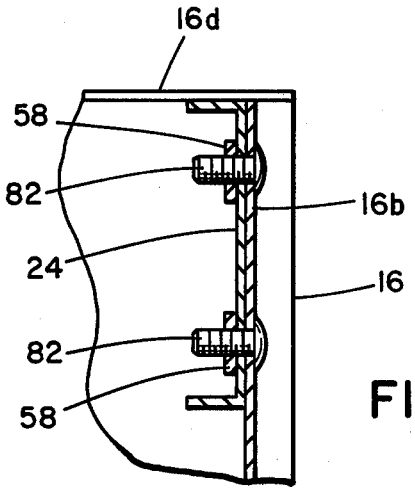
FIG. 5 is a fragmentary sectional view taken substantially along lines 5—5 of FIG. 4.

As best seen in FIG. 1 of the drawings, the cabinet assembly 10 is provided with a shelf 74. To enable the shelf 74 to be positioned within the cabinet, shelf support brackets, such as bracket 76 shown in FIG. 3, are secured in the slots 46 formed in the flange 16*a'* and the flange 16*b* of the side members 16—16. The shelf is adapted to merely rest on the brackets 76. Means, other than the brackets 76, of course, may be employed to support a shelf in the cabinet.

Figure 7:
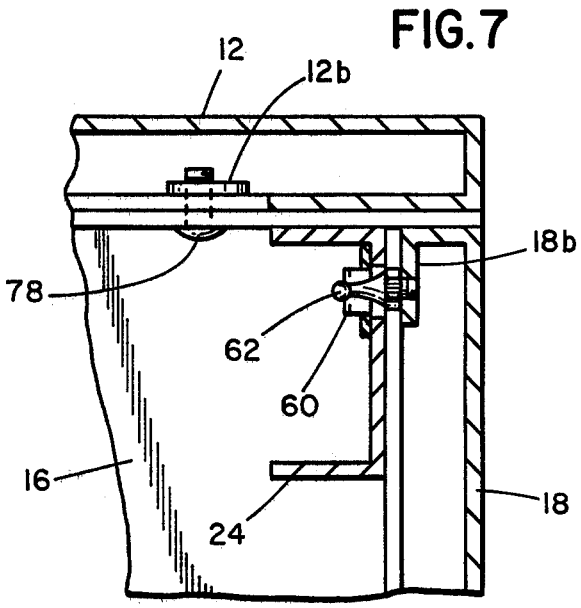
FIG. 7 is an enlarged fragmentary sectional view taken substantially along lines 7—7 of FIG. 1.
Figure 6:
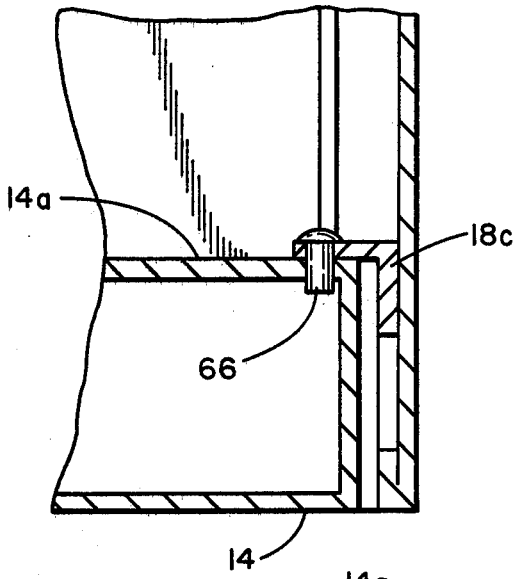
FIG. 6 is a fragmentary top view in perspective showing the rear or back member of the cabinet assembly about to be snapped into position.
Figure 6:
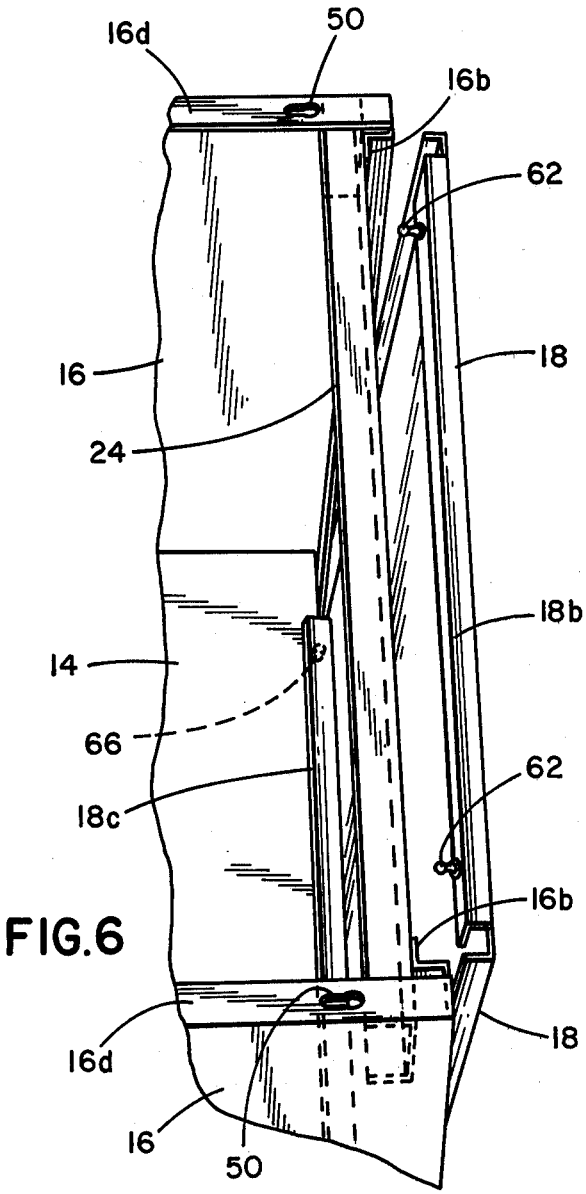

The top member 12 of the assembly 10 has boxed edges. Spaced, screw-receiving openings 12*a*—12*a* are formed in the bottom wall of each of the two lateral boxed edges of the member 12. As shown in FIG. 7, threaded, screw-receiving, nut-like elements such as element 12*b*, are secured as by welding to the inner side of the boxed edges of the member 12 at the openings 12*a*—12*a*. Prior to packaging and shipping, screws, such as socket head screws 78, advantageously are partially threaded into engagement with the openings 12*a*—12*a* and their associated nut-like elements 12*b* to facilitate securing of the top member 12 on the side members 16—16.

In assembling the components of the cabinet assembly, the lower end of the front flange 16*a* and the leg 16*c* below the rear flange 16*b* of the side members 16—16 are secured to the base member 14 by means of screws 80. The front rail 22 is then secured to the upper end of the front flange 16*a* of the side members 16—16, and the rear or back rail 24 is secured to the upper end of the rear flange 16*b* of the side members 16—16, by means of screws 82.

Following the fastening of the front rail 22 and the rear rail 24 to the side members 16—16, casters 34, if used, may be secured to the underside of the base member 14, at the corners thereof, by means of screws 32 (see FIG. 8).

The partially assembled cabinet is then placed in an upright position, and two shelf brackets 76 are secured at the desired height in slots 46—46 in the portion 16*a'* of the front flange 16*a* and the rear flange 16*b* of one side member 16. The shelf 74 is inserted into the cabinet at an angle such that one end of the shelf is above the level of the brackets 76 on the one side member 16. The lowermost end of the shelf 74 is then raised, and two additional shelf brackets 76 are positioned in the slots 46—46 in the portion 16*a'* and the rear flange 16*b* of the other side member 16. The shelf 74 is then lowered into position on the four opposed brackets 76 on the side members 16—16.

The doors 20—20 are hung on the side members 16—16 by aligning the hinge plates 42—42 on the doors 20—20 with the hinge plates 40—40 on the side members 16—16, and dropping the pins 70—70 into engagement with the plates. While for purposes of illustration the pins 70—70 are shown as separated from the hinge plates, it should be understood that the pins may be prefastened on the plates 42—42, for example, thereby facilitating engagement of the doors 20—20 on the side members 16—16. The door handles 72 may then be attached to the doors 20—20 with screws 72*a*.

The top member 12 is then positioned in relation to the top flange 16*d* on the said members 16—16 so that the heads of the screws 78 fit into the keyhole slots 50—50 in the flanges 16*d*. The member 12 thereafter is moved forwardly, and the screws 78 are tightened in the nut-like elements 12*b*.

The back member is secured in position by first engaging the pins 66—66 in the openings 26—26 at the rear margin of the top wall 14*a* of the base member 14, and then swinging the back member 14 against the rear rail 24 to cause the ball studs 62—62 to snap into engagement with the fastening clips 60—60.

As best shown in FIG. 1, all of the screws used in securing the various components of the cabinet assembly together are concealed from view when the cabinet doors are closed. It should also be noted that all of the components are interconnected without requiring the assembler to hold nuts in one hand while screws are secured in position with the other hand. This is made possible, as stated above, by the use of prewelded nut-like elements. Thus, the assembly of the cabinet can be achieved with a single, simple tool.

It should be understood that the embodiment of the invention just described is to be regarded as illustrative of one embodiment, only, of the invention and that the invention may be embodied in other forms without departing from the spirit or essential characteristics thereof.

What is claimed is:

1. A knockdown cabinet comprising a base member, a top member, a pair of side panel members, a rear panel member, a front crosspiece and a rear crosspiece, said base member having a top wall and depending front and rear walls, the top wall of the base member having spaced, pin-receiving openings therethrough along the rear margin thereof, the depending front and rear walls of the base member each having screw-receiving openings therethrough at the ends thereof, each of said screw-receiving openings having a threaded, nut-like element permanently secured in register therewith on the inner surface of the depending front and rear walls of the base member, said side panel members each having inwardly extending front, rear and top flanges, each of the front and rear flanges having screw-receiving openings therethrough at the upper and lower ends thereof, and the top flange having screw-receiving openings therethrough at the front and rear ends thereof, the openings at the lower end of the front and rear flanges of the side panel members being in register with the screw-receiving openings in the depending front and rear walls of the base member and being adapted to receive a screw for securing the lower end of the front and rear flanges of the side panel members to the front and rear walls of the base member through the threaded, nut-like elements on the inner surface of said front and rear walls of the base member, said front and rear crosspieces each having screw-receiving openings therethrough at the ends thereof, each of the openings at the ends of the crosspieces having a threaded, nut-like element permanently secured in register therewith on the inner surface of each of the crosspieces, the screw-receiving openings at the ends of the crosspieces being in register with the screw-receiving openings at the upper end of each of the inwardly extending front and rear flanges of the side panel members and being adapted to receive a screw for securing the upper end of the front and rear flanges of the side panel members to the crosspieces through the threaded, nut-like elements on the inner surface of each of the crosspieces, said top member having a top wall and depending front, rear and side walls, the base of each of the side walls of the top member having screw-receiving openings therethrough, each of the openings in the base of the side walls of the top member having a threaded, nut-like element permanently secured in register therewith inwardly of the base of the side walls of the top member, the screw-receiving openings in the base of the side walls of the top member being in register with the screw-receiving openings in the inwardly extending top flange of each of the side panel members and being adapted to receive a screw for securing the base of the side walls of the top member to the top flange of the side panel members through said threaded, nut-like elements secured inwardly of the base of each of the side walls of the top member, said rear panel member having a pair of spaced pins mounted on the inner surface thereof inwardly of the lower margin of the rear panel member, said pins being adapted to be received in the spaced, pin-receiving openings at the rear margin of the top wall of the base member, said rear panel member further having rear crosspiece engaging fastening means mounted in spaced relation on the inner surface at the upper margin thereof, said pins when engaged in the pin-receiving openings in the top wall of the base member cooperating with the crosspiece engaging fastening means on the inner surface of the rear panel member to enable the rear panel member to be securely fastened in position in abutting relation to the rear crosspiece of the cabinet, said rear crosspiece is provided with fastening clips, and the rear cross-piece engaging fastening means at the upper margin of the rear panel member comprise means which are engaged in the fastening clips on the rear crosspiece, said inwardly extending front and rear flanges of the side panel members are provided with openings for receiving shelf supporting brackets whereby a shelf can be supported within the cabinet.

2. A cabinet according to claim 1 wherein spaced hinge members are provided on the inwardly extending front flange of each of the side panel members, and doors having cooperating hinge members on the outer side margin thereof are mounted on the side panel members by interconnecting the hinge members on the front flanges of the side panel members and the hinge members on the doors.

* * * * *